US011144081B2

(12) United States Patent
Liu

(10) Patent No.: US 11,144,081 B2
(45) Date of Patent: Oct. 12, 2021

(54) BANDGAP VOLTAGE GENERATING APPARATUS AND OPERATION METHOD THEREOF

(71) Applicant: HIMAX TECHNOLOGIES LIMITED, Tainan (TW)

(72) Inventor: Yu-Hsuan Liu, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 16/601,523

(22) Filed: Oct. 14, 2019

(65) Prior Publication Data

US 2021/0109559 A1 Apr. 15, 2021

(51) Int. Cl.
*G05F 3/24* (2006.01)
*G05F 3/08* (2006.01)

(52) U.S. Cl.
CPC . *G05F 3/24* (2013.01); *G05F 3/08* (2013.01)

(58) Field of Classification Search
CPC . G05F 3/30; G05F 1/575; G05F 1/468; G05F 3/267; G05F 1/56; G05F 3/16; G05F 3/262; G05F 3/08; G05F 1/565; G05F 3/02; G05F 3/20; G05F 1/46; G05F 3/26; G05F 3/24; G05F 3/242; G05F 3/245; G05F 3/265; G05F 1/465; G05F 1/571; G05F 1/59; G05F 1/567; G05F 1/613; G05F 3/18; G05F 1/10
See application file for complete search history.

(56) References Cited

U.S. PATENT DOCUMENTS 5,680,017 A * 10/1997 Veldman ..... G05F 1/613 315/209 R
6,396,324 B1 * 5/2002 Hsu ..... G06F 1/04 327/298
8,390,614 B2 * 3/2013 Fan ..... H03L 7/06 345/213
8,742,833 B2 * 6/2014 Hsu ..... H02M 3/07 327/536
9,178,419 B2 * 11/2015 Ito ..... G09G 3/10
2001/0017566 A1 * 8/2001 Nakahara ..... H02M 3/07 327/536
2005/0088158 A1 * 4/2005 Horiguchi ..... G05F 3/242 323/282
2008/0159043 A1 * 7/2008 Lee ..... G11C 5/145 365/226
2009/0089599 A1 * 4/2009 Westwick ..... G06F 1/3203 713/323
2009/0267684 A1 * 10/2009 Do ..... G05F 1/465 327/540
2011/0032027 A1 2/2011 Dash et al.
(Continued)

*Primary Examiner* — Gustavo A Rosario-Benitez
(74) *Attorney, Agent, or Firm* — JCIPRNET

(57) ABSTRACT

A bandgap voltage generating apparatus and an operation method thereof are provided. The bandgap voltage generating apparatus includes a bandgap circuit, a frequency dividing circuit, and a logic circuit. The bandgap circuit is configured to determine whether to generate a bandgap voltage based on an enable clock. The frequency dividing circuit is configured to divide an original clock to generate at least one divided clock. The logic circuit is coupled to the frequency dividing circuit and the bandgap circuit. The logic circuit uses at least one of the at least one divided clock to generate the enable clock for an enable terminal of the bandgap circuit.

13 Claims, 4 Drawing Sheets

(56) References Cited

U.S. PATENT DOCUMENTS

| | | | | |
|---|---|---|---|---|
| 2015/0180333 | A1* | 6/2015 | Jenkner | H02M 3/07<br>327/536 |
| 2015/0309113 | A1* | 10/2015 | Nguyen | G01R 31/31727<br>324/762.01 |
| 2020/0004990 | A1* | 1/2020 | Kurd | H03L 7/095 |

* cited by examiner

BANDGAP VOLTAGE GENERATING APPARATUS AND OPERATION METHOD THEREOF

BACKGROUND

Technical Field

The disclosure relates to a voltage generating circuit, particularly to a bandgap voltage generating apparatus and an operation method thereof.

Related Art

Bandgap circuits are widely used in various electronic circuits. A bandgap voltage provided by a bandgap circuit can be used as a stable reference voltage. In general, the bandgap circuit continuously consumes power to provide the bandgap voltage.

SUMMARY

The disclosure provides a bandgap voltage generating apparatus and an operation method thereof to reduce power consumption of a bandgap circuit.

A bandgap voltage generating apparatus of the disclosure includes a bandgap circuit, a frequency dividing circuit, and a logic circuit. The bandgap circuit is configured to determine whether to generate a bandgap voltage based on an enable clock. The frequency dividing circuit is configured to divide an original clock to generate at least one divided clock. The logic circuit is coupled to the frequency dividing circuit and the bandgap circuit. The logic circuit uses at least one of the at least one divided clock to generate the enable clock for an enable terminal of the bandgap circuit.

An operation method of a bandgap voltage generating apparatus of the disclosure includes the following. Whether to generate a bandgap voltage is determined by a bandgap circuit based on an enable clock. An original clock is divided by a frequency dividing circuit to generate at least one divided clock. At least one of the at least one divided clock is used by a logic circuit to generate the enable clock for an enable terminal of the bandgap circuit.

Based on the above, in the bandgap voltage generating apparatus and the operation method thereof according to embodiments of the disclosure, the bandgap circuit is controlled by the enable clock. The frequency dividing circuit divides the original clock to generate a divided clock. The logic circuit uses the divided clock to generate the enable clock for the bandgap circuit. The bandgap circuit determines whether to generate the bandgap voltage based on the enable clock. Therefore, power consumption of the bandgap circuit can be reduced.

To make the above features and advantages of the disclosure more comprehensible, examples accompanied with drawings are described in detail as follows.

DESCRIPTION OF THE EMBODIMENTS

Figure 1:
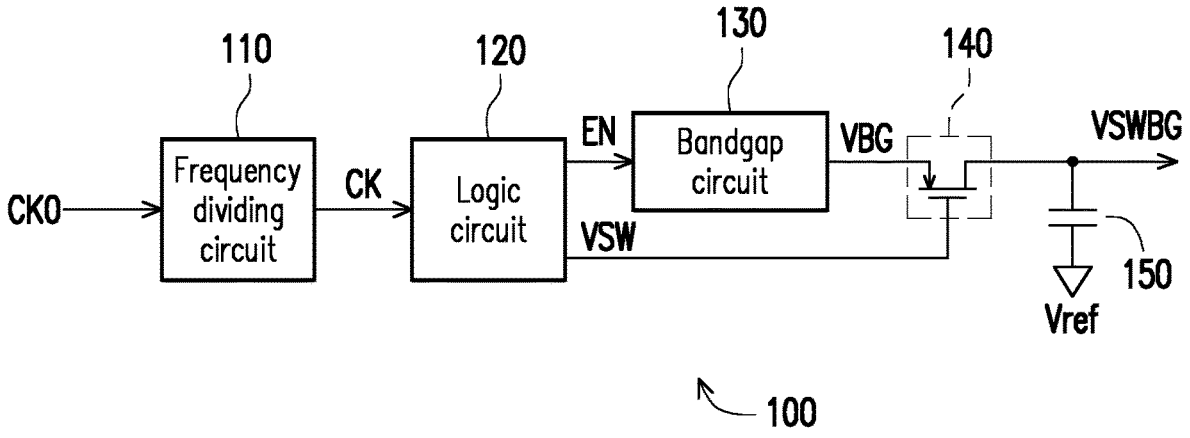
FIG. 1 is a schematic circuit block diagram of a bandgap voltage generating apparatus according to an embodiment of the disclosure.

The term "couple (or connect)" used in this specification (including claims) may refer to any direct or indirect connection means. For example, "a first apparatus is coupled (or connected) to a second apparatus" should be interpreted as "the first apparatus is directly connected to the second apparatus" or "the first apparatus is indirectly connected to the second apparatus through other apparatuses or connection means." The terms such as "first," "second" and so on mentioned throughout the specification (including the claims) are used to name elements, or for distinguishing different embodiments or scopes, instead of restricting the upper limit or the lower limit of the number of the elements, nor limiting the order of the elements. Moreover, wherever appropriate in the drawings and embodiments, elements/components/steps with the same reference numerals represent the same or similar parts. Elements/components/steps with the same reference numerals or names in different embodiments may be cross-referenced.

FIG. 1 is a schematic circuit block diagram of a bandgap voltage generating apparatus 100 according to an embodiment of the disclosure. In the embodiment shown in FIG. 1, the bandgap voltage generating apparatus 100 includes a frequency dividing circuit 110, a logic circuit 120, a bandgap circuit 130 (having enable/disable function), and a switch 140. Implementation details of the bandgap circuit 130 are not limited by the present embodiment. For example, the bandgap circuit 130 with enable/disable function may include a conventional bandgap circuit or other bandgap circuit.

The bandgap circuit 130 determines whether to generate a bandgap voltage VBG based on an enable clock EN. During an enable period of the enable clock EN, the bandgap circuit 130 can be enabled. Outside the enable period, the bandgap circuit 130 can be disabled. When the bandgap circuit 130 is disabled, power consumption of the bandgap circuit 130 can be reduced. For example, the enable clock EN may determine a power state of the bandgap circuit 130. When the enable clock EN has a high logic voltage (during the enable period), the bandgap circuit 130 can be powered (enabled). Outside the enable period, power of the bandgap circuit 130 can be turned off (disabled).

A first terminal of the switch 140 is coupled to an output terminal of the bandgap circuit 130 to receive the bandgap voltage VBG. A control terminal of the switch 140 is coupled to the logic circuit 120 to receive a switch clock VSW. Implementation details of the switch 140 are not limited by the present embodiment. For example, the switch 140 shown in FIG. 1 includes a p-channel metal oxide semiconductor (PMOS) transistor. A first terminal of a capacitor 150 is coupled to a second terminal of the switch 140. A second terminal of the capacitor 150 is coupled to a reference voltage Vref (e.g., ground voltage or other fixed voltage). In the case where the bandgap circuit 130 is enabled, when the switch 140 is turned on, the bandgap voltage VBG can be stored in the capacitor 150 (to serve as a bandgap voltage VSWBG). Therefore, the capacitor 150 may provide the bandgap voltage VSWBG to a next stage circuit (not shown) (e.g., a voltage regulating circuit or other circuit). When the bandgap circuit 130 is disabled and the switch 140 is turned off, the capacitor 150 may hold the bandgap voltage VSWBG. Therefore, the power consumption of the bandgap circuit 130 can be reduced.

Figure 2:
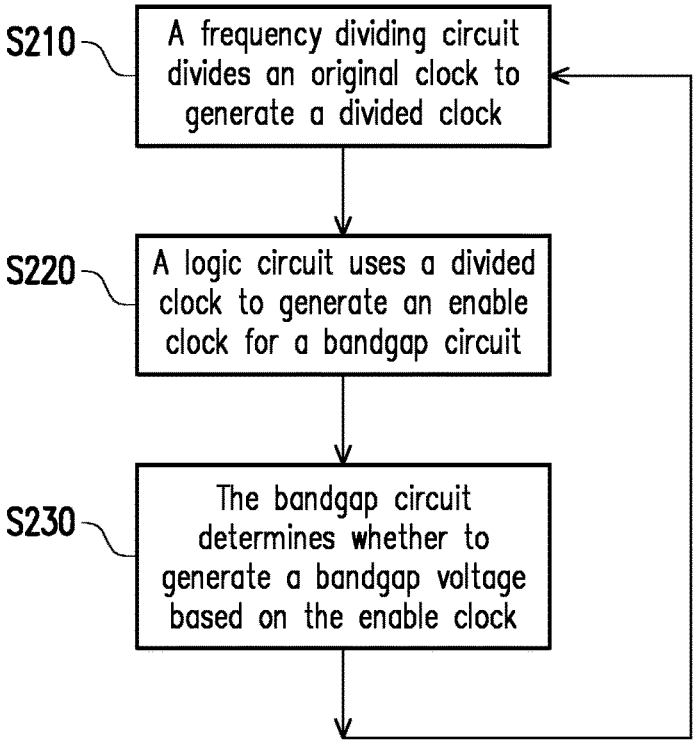
FIG. 2 is a schematic flowchart of an operation method of a bandgap voltage generating apparatus according to an embodiment of the disclosure.

FIG. 2 is a schematic flowchart of an operation method of a bandgap voltage generating apparatus according to an embodiment of the disclosure. Please refer to FIG. 1 and FIG. 2. In step S210, the frequency dividing circuit 110 divides an original clock CK0 to generate at least one divided clock CK. Implementation details of the frequency dividing circuit 110 are not limited by the present embodiment. For example, the frequency dividing circuit 110 may include a conventional frequency divider or other frequency dividing circuit, depending on design requirements.

The logic circuit 120 is coupled to the frequency dividing circuit 110 and the bandgap circuit 130. In step S220, the logic circuit 120 uses at least one of the at least one divided clock CK of the frequency dividing circuit 110 to generate the enable clock EN for an enable terminal of the bandgap circuit 130. In addition, the logic circuit 120 further uses at least two of the original clock CK0 and the at least one divided clock CK to generate the switch clock VSW for the control terminal of the switch 140.

Figure 3:
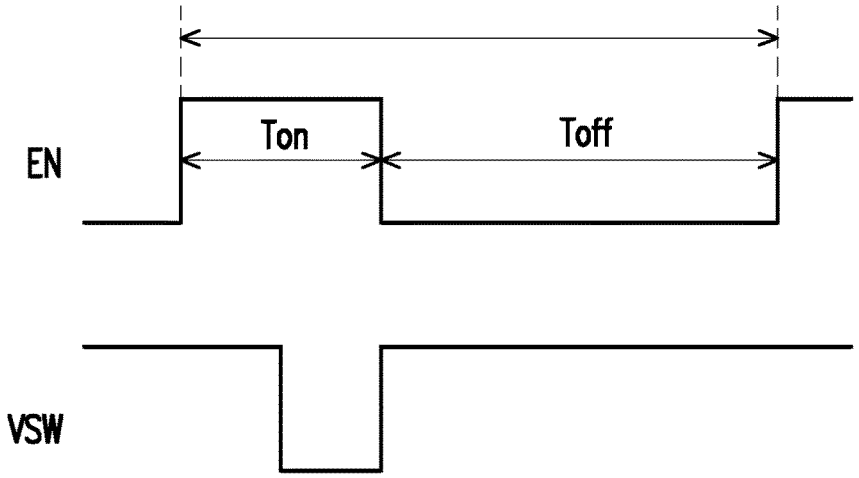
FIG. 3 is a schematic timing diagram for illustrating an enable clock and a switch clock shown in FIG. 1 according to an embodiment of the disclosure.

FIG. 3 is a schematic timing diagram for illustrating the enable clock EN and the switch clock VSW shown in FIG. 1 according to an embodiment of the disclosure. Please refer to FIG. 1 and FIG. 3. When the enable clock EN is at a high logic level (i.e., during an enable period Ton of the enable clock EN), the bandgap circuit 130 is enabled. When the enable clock EN is at a low logic level (i.e., during a disable period Toff of the enable clock EN), the bandgap circuit 130 is disabled. When the switch clock VSW is at a high logic level, the switch 140 is turned off. When the switch clock VSW is at a low logic level (i.e., during an on period of the switch clock VSW), the switch 140 is turned on. The enable period Ton of the enable clock EN is longer than the on period of the switch clock VSW, and the on period falls within the enable period Ton, as shown in FIG. 3. Current consumption of the bandgap circuit 130 depends on a duty cycle of the enable clock EN. Depending on design requirements, the enable period Ton of the enable clock EN may be longer than twice a wake up time of the bandgap circuit 130.

Please refer to FIG. 1 and FIG. 2. In step S230, the bandgap circuit 130 determines whether to generate the bandgap voltage VBG based on the enable clock EN. When the bandgap circuit 130 is enabled based on the enable clock EN and the switch 140 is turned on based on the switch clock VSW, the bandgap voltage VBG can be stored in the capacitor 150 (to serve as the bandgap voltage VSWBG). When the bandgap circuit 130 is disabled based on the enable clock EN, the power consumption of the bandgap circuit 130 can be reduced.

Figure 4:
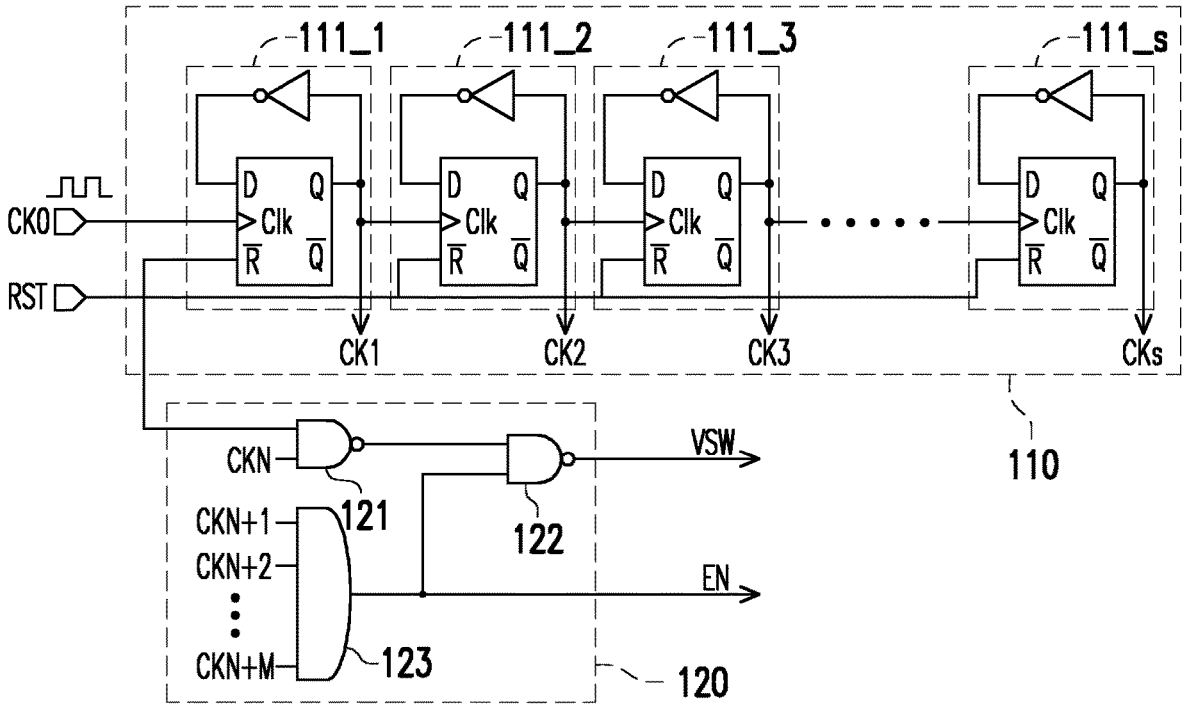
FIG. 4 is a schematic circuit block diagram for illustrating a frequency dividing circuit and a logic circuit shown in FIG. 1 according to an embodiment of the disclosure.

FIG. 4 is a schematic circuit block diagram for illustrating the frequency dividing circuit 110 and the logic circuit 120 shown in FIG. 1 according to an embodiment of the disclosure. The frequency dividing circuit 110 includes at least one unit circuit. In the embodiment shown in FIG. 4, the frequency dividing circuit 110 includes s unit circuits 111_1, 111_2, 111_3, . . . , and **111_*s*, wherein s is an integer greater than zero. The number s of the unit circuits can be determined according to design requirements. The unit circuits 111_1 to 111_*s* are connected to each other in series to form a unit string. An input terminal of the first unit circuit 111_1 in the unit string receives the original clock CK0. Input terminals of the other unit circuits are respectively coupled to output terminals of previous stage unit circuits, as shown in FIG. 4. The output terminals of the unit circuits 111_1 to 111_*s* generate divided clocks CK1, CK2, CK3**, . . . , and CKs (i.e., the at least one divided clock CK).

Any one of the unit circuits 111_1 to **111_*s* includes a flip-flop and a NOT gate. A clock trigger terminal Clk of the flip-flop is used as an input terminal of a unit circuit, an output terminal Q of the flip-flop is used as an output terminal of the unit circuit, an input terminal of the NOT gate is coupled to the output terminal Q of the flip-flop, and an output terminal of the NOT gate is coupled to a data input terminal D of the flip-flop, as shown in FIG. 4. Reset terminals of the flip-flops of the unit circuits 111_1 to 111_*s* are controlled by a reset signal RST. When the reset signal RST is at a low logic level, the flip-flops of the unit circuits 111_1 to 111_*s* are reset. The output terminals Q of the flip-flops of the unit circuits 111_1 to 111_*s* provide the divided clocks CK1** to CKs.

In the embodiment shown in FIG. 4, the logic circuit 120 includes a NAND gate 121, a NAND gate 122, and an AND gate 123. A first input terminal of the NAND gate 121 receives the reset signal RST. A second input terminal of the NAND gate 121 receives a clock CKN. Depending on design requirements, the clock CKN may be one of the original clock CK0 and the at least one divided clock CK (e.g., the divided clocks CK1 to CKs−1). A first input terminal of the NAND gate 122 is coupled to an output terminal of the NAND gate 121. An output terminal of the NAND gate 122 is coupled to the control terminal of the switch 140 to provide the switch clock VSW. In the case where a voltage at a second input terminal of the NAND gate 122 is at a high logic level and the reset signal RST is also at a high logic level, a negative pulse of the clock CKN can be transmitted as the switch clock VSW to the control terminal of the switch 140.

An output terminal of the AND gate 123 is coupled to the second input terminal of the NAND gate 122. The output terminal of the AND gate 123 is further coupled to the enable terminal of the bandgap circuit 130 to provide the enable clock EN. A plurality of input terminals of the AND gate 123 are coupled to the frequency dividing circuit 110 to receive clocks CKN+1, CKN+2, . . . , and CKN+M, wherein M is an integer greater than zero. The number M of the clocks CKN+1 to CKN+M can be determined according to design requirements.

A pulse width of the clock CKN transmitted to the second input terminal of the NAND gate 121 is smaller than a pulse width of the clocks (divided clocks) CKN+1 to CKN+M transmitted to the input terminals of the AND gate 123. In other words, a period of the clocks CKN+1 to CKN+M is greater than a period of the clock CKN. Depending on design requirements, the clocks CKN+1 to CKN+M may be at least two of the at least one divided clock CK (e.g., at least two of the divided clocks CK1 to CKs). For example, in the case where the clock CKN is the original clock CK0, the clocks CKN+1 to CKN+M may be at least two of the divided clocks CK1 to CKs. In another embodiment, in the case where the clock CKN is the divided clock CK1, the clocks CKN+1 to CKN+M may be at least two of the divided clocks CK2 to CKs. In still another embodiment, in the case where the clock CKN is the divided clock CK2, the clocks CKN+1 to CKN+M may be at least two of the divided clocks CK3 to CKs.

According to the selection of the clocks CKN+1 to CKN+M, the enable period Ton and the disable period Toff of the enable clock EN can be set. The pulse width of a clock having a smallest period among the clocks CKN+1 to CKN+M determines a width of the enable period Ton. The period of a clock having a largest period among the clocks CKN+1 to CKN+M determines a period of the enable clock EN, thereby determining the disable period Toff.

Figure 5:
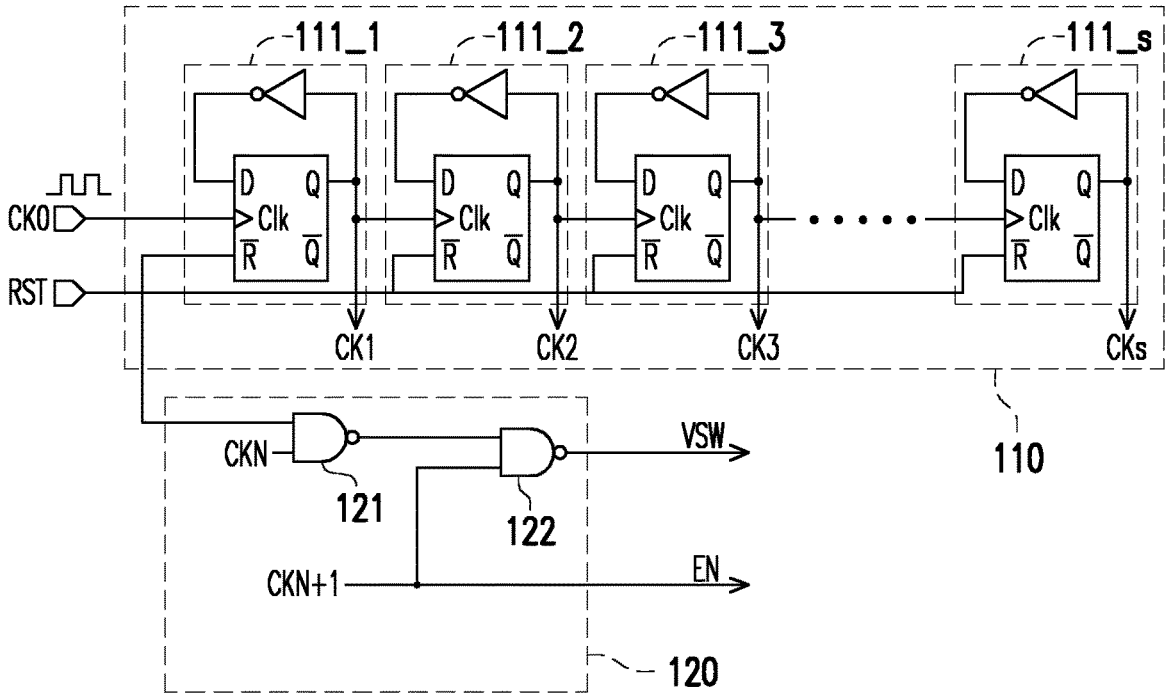
FIG. 5 is a schematic circuit block diagram for illustrating the logic circuit shown in FIG. 1 according to another embodiment of the disclosure.

FIG. 5 is a schematic circuit block diagram for illustrating the logic circuit 120 shown in FIG. 1 according to another embodiment of the disclosure. Details of the frequency dividing circuit 110 shown in FIG. 5 may be understood with reference to the related description of FIG. 4 and are thus omitted. The logic circuit 120 shown in FIG. 5 includes the NAND gate 121 and the NAND gate 122. Details of the NAND gate 121 and the NAND gate 122 shown in FIG. 5 may be understood with reference to the related description of the NAND gate 121 and the NAND gate 122 shown in FIG. 4 and are thus omitted.

In the embodiment shown in FIG. 5, the second input terminal of the NAND gate 122 is coupled to the frequency dividing circuit 110 to receive the clock CKN+1. Depending on design requirements, the clock CKN+1 may be one of the at least one divided clock CK (e.g., the divided clocks CK1 to CKs). The clock (divided clock) CKN+1 transmitted to the second input terminal of the NAND gate 122 may be used as the enable clock EN. The pulse width of the clock CKN transmitted to the second input terminal of the NAND gate 121 is smaller than the pulse width of the clock (divided clock) CKN+1 transmitted to the second input terminal of the NAND gate 122. In other words, the period of the clock CKN+1 is greater than the period of the clock CKN.

For example, in the case where the clock CKN is the original clock CK0, the clock CKN+1 may be the divided clock CK1. In another embodiment, in the case where the clock CKN is the divided clock CK1, the clock CKN+1 may be the divided clock CK2. In still another embodiment, in the case where the clock CKN is the divided clock CK2, the clock CKN+1 may be the divided clock CK3. According to the selection of the clock CKN+1, the enable period Ton and the disable period Toff of the enable clock EN can be set.

Figure 6:
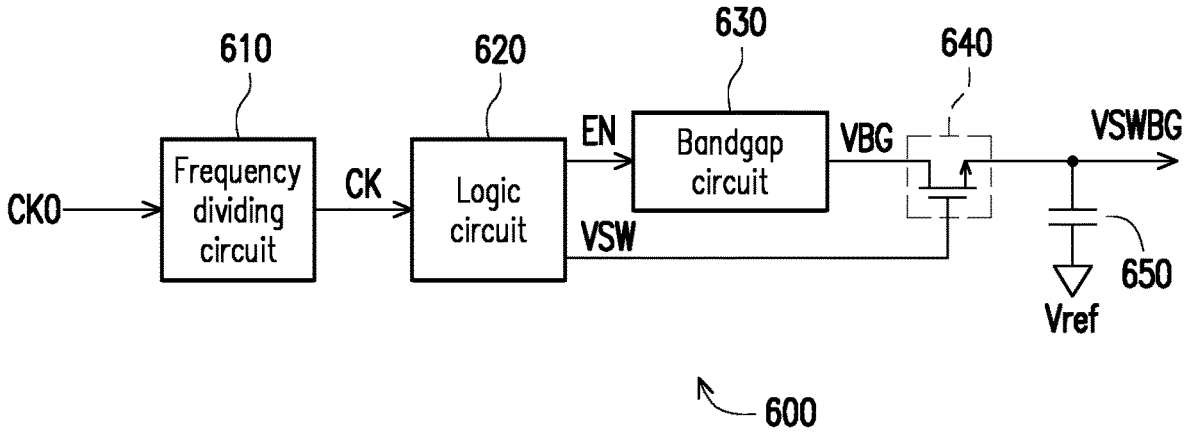
FIG. 6 is a schematic circuit block diagram of a bandgap voltage generating apparatus according to another embodiment of the disclosure.

FIG. 6 is a schematic circuit block diagram of a bandgap voltage generating apparatus 600 according to another embodiment of the disclosure. In the embodiment shown in FIG. 6, the bandgap voltage generating apparatus 600 includes a frequency dividing circuit 610, a logic circuit 620, a bandgap circuit 630, a switch 640 and a capacitor 650. Details of the bandgap voltage generating apparatus 600, the frequency dividing circuit 610, the logic circuit 620, the bandgap circuit 630, the switch 640 and the capacitor 650 shown in FIG. 6 may be understood by analogy with the related description of the bandgap voltage generating apparatus 100, the frequency dividing circuit 110, the logic circuit 120, the bandgap circuit 130, the switch 140 and the capacitor 150 shown in FIG. 1 and are thus omitted. The related description of FIG. 2 also applies to the embodiment shown in FIG. 6. In addition, details of the frequency dividing circuit 610 shown in FIG. 6 may be understood with reference to the related description of the frequency dividing circuit 110 shown in FIG. 4 and are thus omitted.

In the embodiment shown in FIG. 6, the switch 640 includes an n-channel metal oxide semiconductor (NMOS) transistor. In the case where the bandgap circuit 630 is enabled, when the switch 640 is turned on, the bandgap voltage VBG can be stored in the capacitor 650 (to serve as the bandgap voltage VSWBG). Therefore, the capacitor 650 may provide the bandgap voltage VSWBG to a next stage circuit (not shown) (e.g., a voltage regulating circuit or other circuit). When the bandgap circuit 630 is disabled and the switch 640 is turned off, the capacitor 650 may hold the bandgap voltage VSWBG. Therefore, power consumption of the bandgap circuit 630 can be reduced.

Figure 7:
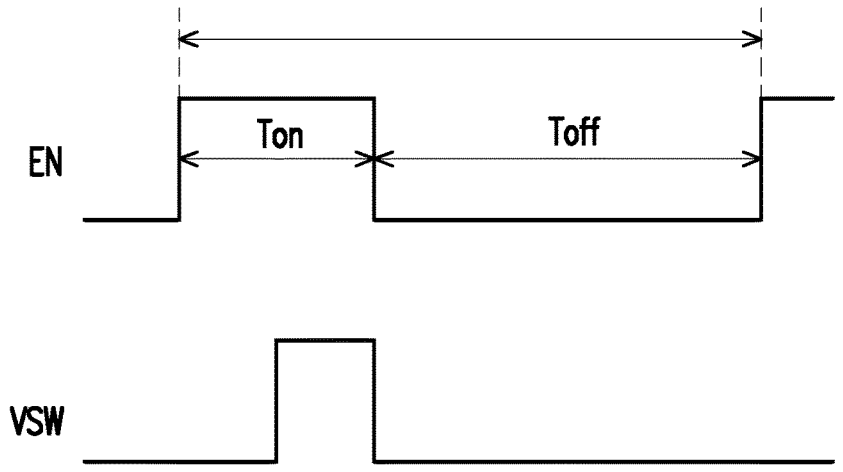
FIG. 7 is a schematic timing diagram for illustrating an enable clock and a switch clock shown in FIG. 6 according to an embodiment of the disclosure.

FIG. 7 is a schematic timing diagram for illustrating the enable clock EN and the switch clock VSW shown in FIG. 6 according to an embodiment of the disclosure. Please refer to FIG. 6 and FIG. 7. When the enable clock EN is at a high logic level (i.e., during the enable period Ton of the enable clock EN), the bandgap circuit 630 is enabled. When the enable clock EN is at a low logic level (i.e., during the disable period Toff of the enable clock EN), the bandgap circuit 630 is disabled. When the switch clock VSW is at a low logic level, the switch 640 is turned off. When the switch clock VSW is at a high logic level (i.e., during the on period of the switch clock VSW), the switch 640 is turned on. The enable period Ton of the enable clock EN is longer than the on period of the switch clock VSW, and the on period falls within the enable period Ton, as shown in FIG. 7. Current consumption of the bandgap circuit 630 depends on the duty cycle of the enable clock EN. Depending on design requirements, the enable period Ton of the enable clock EN may be longer than twice a wake up time of the bandgap circuit 630.

Figure 8:
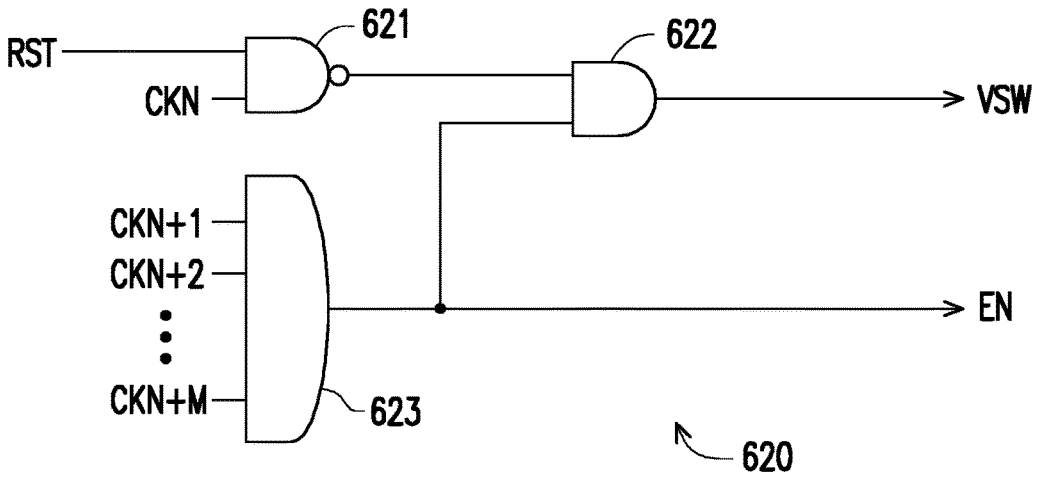
FIG. 8 is a schematic circuit block diagram for illustrating a logic circuit shown in FIG. 6 according to an embodiment of the disclosure.

FIG. 8 is a schematic circuit block diagram for illustrating the logic circuit 620 shown in FIG. 6 according to an embodiment of the disclosure. The logic circuit 620 shown in FIG. 8 includes a NAND gate 621, an AND gate 622, and an AND gate 623. A first input terminal of the NAND gate 621 receives the reset signal RST. A second input terminal of the NAND gate 621 receives the clock CKN. Depending on design requirements, the clock CKN may be one of the original clock CK0 and the at least one divided clock CK (e.g., the divided clocks CK1 to CKs). A first input terminal of the AND gate 622 is coupled to an output terminal of the NAND gate 621. An output terminal of the AND gate 622 is coupled to a control terminal of the switch 640 to provide the switch clock VSW. In the case where a voltage at a second input terminal of the AND gate 622 is at a high logic level and the reset signal RST is also at a high logic level, the clock CKN can be inverted and transmitted as the switch clock VSW to the control terminal of the switch 640.

An output terminal of the AND gate 623 is coupled to the second input terminal of the AND gate 622. The output terminal of the AND gate 623 is further coupled to an enable terminal of the bandgap circuit 630 to provide the enable clock EN. A plurality of input terminals of the AND gate 623 are coupled to the frequency dividing circuit 610 to receive the clocks CKN+1, CKN+2, . . . , and CKN+M, wherein M is an integer greater than zero. The number M of the clocks CKN+1 to CKN+M can be determined according to design requirements. Depending on design requirements, the clocks CKN+1 to CKN+M may be at least two of the at least one divided clock CK (e.g., at least two of the divided clocks CK1 to CKs).

The pulse width of the clock CKN transmitted to the second input terminal of the NAND gate 621 is smaller than the pulse width of the clocks (divided clocks) CKN+1 to CKN+M transmitted to the input terminals of the AND gate 623. In other words, the period of the clocks CKN+1 to CKN+M is greater than the period of the clock CKN. For example, in the case where the clock CKN is the original clock CK0, the clocks CKN+1 to CKN+M may be at least two of the divided clocks CK1 to CKs. In another embodiment, in the case where the clock CKN is the divided clock CK1, the clocks CKN+1 to CKN+M may be at least two of the divided clocks CK2 to CKs. In still another embodiment, in the case where the clock CKN is the divided clock CK2, the clocks CKN+1 to CKN+M may be at least two of the divided clocks CK3 to CKs.

According to the selection of the clocks CKN+1 to CKN+M, the enable period Ton and the disable period Toff of the enable clock EN can be set. The pulse width of a clock having a smallest period among the clocks CKN+1 to CKN+M determines the width of the enable period Ton. The period of a clock having a largest period among the clocks CKN+1 to CKN+M determines the period of the enable clock EN, thereby determining the disable period Toff.

Figure 9:
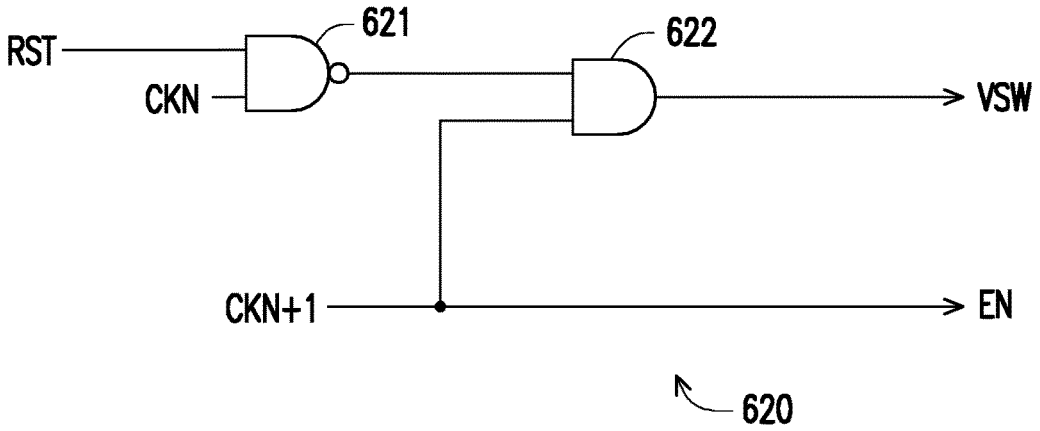
FIG. 9 is a schematic circuit block diagram for illustrating the logic circuit shown in FIG. 6 according to another embodiment of the disclosure.

FIG. 9 is a schematic circuit block diagram for illustrating the logic circuit 620 shown in FIG. 6 according to another embodiment of the disclosure. The logic circuit 620 shown in FIG. 9 includes the NAND gate 621 and the AND gate 622. Details of the NAND gate 621 and the AND gate 622 shown in FIG. 9 may be understood with reference to the related description of the NAND gate 621 and the AND gate 622 shown in FIG. 8 and are thus omitted. In the embodiment shown in FIG. 9, the second input terminal of the AND gate 622 is coupled to the frequency dividing circuit 610 to receive the clock CKN+1. Depending on design requirements, the clock CKN+1 may be one of the at least one divided clock CK (e.g., the divided clocks CK1 to CKs). The clock (divided clock) CKN+1 transmitted to the second input terminal of the AND gate 622 may be used as the enable clock EN. The pulse width of the clock CKN transmitted to the second input terminal of the NAND gate 621 is smaller than the pulse width of the clock (divided clock) CKN+1 transmitted to the second input terminal of the AND gate 622. In other words, the period of the clock CKN+1 is greater than the period of the clock CKN.

For example, in the case where the clock CKN is the original clock CK0, the clock CKN+1 may be the divided clock CK1. In another embodiment, in the case where the clock CKN is the divided clock CK1, the clock CKN+1 may be the divided clock CK2. In still another embodiment, in the case where the clock CKN is the divided clock CK2, the clock CKN+1 may be the divided clock CK3. According to the selection of the clock CKN+1, the enable period Ton and the disable period Toff of the enable clock EN can be set.

In summary, the bandgap voltage generating apparatus according to the embodiments of the disclosure controls the bandgap circuit by the enable clock EN. The frequency dividing circuit divides the original clock CK0 to generate the divided clock CK (e.g., the divided clocks CK1 to CKs). The logic circuit uses the divided clock CK to generate the enable clock EN for the bandgap circuit. The bandgap circuit determines whether to generate a bandgap voltage based on the enable clock EN. Therefore, power consumption of the bandgap circuit can be reduced.

Although the disclosure has been described with reference to the above examples, it will be apparent to one of ordinary skill in the art that modifications to the described examples may be made without departing from the spirit of the disclosure. Accordingly, the scope of the disclosure will be defined by the attached claims and not by the above detailed descriptions.

What is claimed is:

1. A bandgap voltage generating apparatus comprising:

a bandgap circuit configured to determine whether to generate a bandgap voltage based on an enable clock;

a frequency dividing circuit configured to divide an original clock to generate at least one divided clock;

a logic circuit coupled to the frequency dividing circuit and the bandgap circuit, wherein the logic circuit uses at least one of the at least one divided clock to generate the enable clock for an enable terminal of the bandgap circuit; and a switch having a first terminal coupled to an output terminal of the bandgap circuit to receive the bandgap voltage;

wherein the logic circuit further uses at least two of the original clock and the at least one divided clock to generate a switch clock for a control terminal of the switch;

wherein the logic circuit comprises:

a first NAND gate having a first input terminal configured to receive a reset signal, wherein a second input terminal of the first NAND gate is configured to receive one of the original clock and the at least one divided clock; and a second NAND gate having a first input terminal coupled to an output terminal of the first NAND gate, wherein a second input terminal of the second NAND gate is coupled to the frequency dividing circuit to receive one of the at least one divided clock, and an output ten iinal of the second NAND gate is coupled to the control terminal of the switch to provide the switch clock;

wherein at least one of the divided clock transmitted to the second input terminal of the second NAND gate is used as the enable clock.

2. The bandgap voltage generating apparatus according to claim 1, wherein the switch is turned on during an on period of the switch clock, the bandgap circuit is enabled during an enable period of the enable clock, the enable period is longer than the on period, and the on period falls within the enable period.

3. The bandgap voltage generating apparatus according to claim 1, wherein the logic circuit further comprises:

an AND gate having a plurality of input terminals coupled to the frequency dividing circuit to receive at least two of the at least one divided clock, wherein an output terminal of the AND gate is coupled to the second input terminal of the second NAND gate, and the output terminal of the AND gate is coupled to the enable terminal of the bandgap circuit to provide the enable clock.

4. The bandgap voltage generating apparatus according to claim 3, wherein a pulse width of the one of the original clock and the at least one divided clock transmitted to the second input terminal of the first NAND gate is smaller than a pulse width of the divided clocks transmitted to the plurality of input terminals of the AND gate.

5. The bandgap voltage generating apparatus according to claim 1, wherein a pulse width of the one of the original clock and the at least one divided clock transmitted to the second input terminal of the first NAND gate is smaller than a pulse width of the divided clock transmitted to the second input terminal of the second NAND gate.

6. A bandgap voltage generating apparatus comprising:

a bandgap circuit configured to determine whether to generate a bandgap voltage based on an enable clock;

a frequency dividing circuit configured to divide an original clock to generate at least one divided clock;

a logic circuit coupled to the frequency dividing circuit and the bandgap circuit, wherein the logic circuit uses at least one of the at least one divided clock to generate the enable clock for an enable terminal of the bandgap circuit; and a switch having a first terminal coupled to an output terminal of the bandgap circuit to receive the bandgap voltage;

wherein the logic circuit further uses at least two of the original clock and the at least one divided clock to generate a switch clock for a control terminal of the switch;

wherein the logic circuit comprises:

a NAND gate having a first input terminal configured to receive a reset signal, wherein a second input terminal of the NAND gate is configured to receive one of the original clock and the at least one divided clock; and an AND gate having a first input terminal coupled to an output terminal of the NAND gate, wherein a second input terminal of the AND gate is coupled to the frequency dividing circuit to receive one of the at least one divided clock, and an output terminal of the AND gate is coupled to the control terminal of the switch to provide the switch clock;

wherein at least one of the divided clock transmitted to the second input terminal of the AND gate is used as the enable clock.

7. The bandgap voltage generating apparatus according to claim 6, wherein a pulse width of the one of the original clock and the at least one divided clock transmitted to the second input terminal of the NAND gate is smaller than a pulse width of the divided clock transmitted to the second input terminal of the AND gate.

8. The bandgap voltage generating apparatus according to claim 1, wherein the frequency dividing circuit comprises:

a plurality of unit circuits connected to each other in series to form a unit string, wherein an input terminal of a first unit circuit in the unit string receives the original clock, and an output terminal of at least one of the plurality of unit circuits generates the at least one divided clock.

9. The bandgap voltage generating apparatus according to claim 8, wherein any one of the plurality of unit circuits comprises:

a flip-flop having a clock trigger terminal as the input terminal of the unit circuit, wherein an output terminal of the flip-flop is used as the output terminal of the unit circuit; and a NOT gate having an input terminal coupled to the output terminal of the flip-flop, wherein an output terminal of the NOT gate is coupled to a data input terminal of the flip-flop.

10. An operation method of a bandgap voltage generating apparatus, comprising:

determining, by a bandgap circuit, whether to generate a bandgap voltage based on an enable clock;

dividing, by a frequency dividing circuit, an original clock to generate at least one divided clock;

using, by a logic circuit, at least one of the at least one divided clock to generate the enable clock for an enable terminal of the bandgap circuit; and using at least two of the original clock and the at least one divided clock to generate a switch clock for a control terminal of a switch by the logic circuit, wherein a first terminal of the switch is coupled to an output terminal of the bandgap circuit to receive the bandgap voltage;

wherein the logic circuit comprises:

a first NAND gate having a first input terminal configured to receive a reset signal, wherein a second input teiminal of the first NAND gate is configured to receive one of the original clock and the at least one divided clock; and a second NAND gate having a first input terminal coupled to an output terminal of the first NAND gate, wherein a second input terminal of the second NAND gate is coupled to the frequency dividing circuit to receive one of the at least one divided clock, and an output terminal of the second NAND gate is coupled to the control terminal of the switch to provide the switch clock;

wherein at least one of the divided clock transmitted to the second input terminal of the second NAND gate is used as the enable clock.

11. The operation method according to claim 10, wherein the switch is turned on during an on period of the switch clock, the bandgap circuit is enabled during an enable period of the enable clock, the enable period is longer than the on period, and the on period falls within the enable period.

12. The bandgap voltage generating apparatus according to claim 6, wherein the logic circuit further comprises:

a second AND gate having a plurality of input terminals coupled to the frequency dividing circuit to receive at least two of the at least one divided clock, wherein an output terminal of the second AND gate is coupled to a second input terminal of the AND gate, and the output terminal of the second AND gate is coupled to the enable terminal of the bandgap circuit to provide the enable clock.

13. The bandgap voltage generating apparatus according to claim 12, wherein a pulse width of the one of the original clock and the at least one divided clock transmitted to the second input terminal of the NAND gate is smaller than a pulse width of the divided clocks transmitted to the plurality of input terminals of the second AND gate.

* * * * *